US009072947B2

(12) United States Patent
Sander et al.

(10) Patent No.: US 9,072,947 B2
(45) Date of Patent: Jul. 7, 2015

(54) RELEASABLE CONNECTIONS FOR GOLF CLUB HEADS AND SHAFTS

(71) Applicant: NIKE, Inc., Beaverton, OR (US)

(72) Inventors: Raymond J. Sander, Benbrook, TX (US); James Thomas, Ft. Worth, TX (US); Vincent J. Contini, Powell, OH (US); James A. Prescott, Columbus, OH (US); Matthew P. Rubal, Columbus, OH (US); Gregory A. Trees, Loveland, OH (US)

(73) Assignee: Nike, Inc., Beaverton, OR (US)

( * ) Notice: Subject to any disclaimer, the term of this patent is extended or adjusted under 35 U.S.C. 154(b) by 82 days.

(21) Appl. No.: 13/862,837

(22) Filed: Apr. 15, 2013

(65) Prior Publication Data

US 2013/0316844 A1 Nov. 28, 2013

Related U.S. Application Data

(63) Continuation of application No. 13/455,853, filed on Apr. 25, 2012, now Pat. No. 8,419,563, which is a continuation of application No. 13/098,017, filed on Apr. 29, 2011, now Pat. No. 8,182,358, which is a continuation of application No. 12/269,662, filed on Nov. 12, 2008, now Pat. No. 7,963,855.

(51) Int. Cl.
*A63B 53/02* (2006.01)
*A63B 53/04* (2015.01)

(52) U.S. Cl.
CPC ..... *A63B 53/02* (2013.01); *Y10T 29/49948* (2015.01); *A63B 53/0466* (2013.01); *A63B 2053/023* (2013.01); *A63B 53/047* (2013.01); *A63B 53/0487* (2013.01)

(58) Field of Classification Search
CPC ..... A63B 2053/022; A63B 2053/023; A63B 2053/024; A63B 2053/025; A63B 2053/026; A63B 2053/027; A63B 53/02
USPC ..... 473/288, 307, 244–248; 403/361, 373, 403/374.4, 375, 381
See application file for complete search history.

(56) References Cited

U.S. PATENT DOCUMENTS 1,792,852 A 2/1931 Mattern
1,850,843 A 3/1932 Lagerblade
(Continued)

FOREIGN PATENT DOCUMENTS

GB 443439 A 2/1936
GB 2331464 A 5/1999
(Continued)

OTHER PUBLICATIONS

Aug. 5, 2010—(WO) International Search Report—App PCT/US2009/062046.
(Continued)

*Primary Examiner* — Stephen Blau
(74) *Attorney, Agent, or Firm* — Banner & Witcoff, Ltd.

(57) ABSTRACT

Golf club heads are releasably engaged with shafts so that the club heads and shafts can be readily interchanged and/or so that the shaft position with respect to the club head can be readily changed. Golf clubs are provided that have spherical releasable connections between the golf club head and the golf club shaft along with head/shaft position adjusting features to allow interchange of shafts and heads and to allow modification of the head/shaft positioning properties. Assemblies for connecting the club head and shaft may include: a shaft adapter, a shaft retainer, and a hosel insert located within an interior chamber of the club head. The club head and shaft may be changed by releasing the securing system and exchanging the original parts with different parts. Furthermore, the shaft adapter may be rotated within the hosel insert to create different angles from the shaft so as to allow adjustment of the shaft position with respect to the club head.

20 Claims, 6 Drawing Sheets

(56) References Cited

U.S. PATENT DOCUMENTS

| | | | | |
|---|---|---|---|---|
| 2,067,556 | A | 1/1937 | Wettlaufer | |
| 2,219,670 | A | 10/1940 | Wettlaufer | |
| 2,451,262 | A | 10/1948 | Watkins | |
| 2,464,850 | A | 3/1949 | Crawshaw | |
| 3,206,206 | A | 9/1965 | Santosuosso | |
| 3,516,697 | A | 6/1970 | Hahn | |
| 3,524,646 | A | 8/1970 | Wheeler | |
| 3,656,366 | A | 4/1972 | Somero | |
| 3,848,737 | A | 11/1974 | Kenon | |
| 3,891,212 | A | 6/1975 | Hill | |
| 4,073,492 | A * | 2/1978 | Taylor | 473/409 |
| 4,253,666 | A | 3/1981 | Murphy | |
| 4,340,227 | A | 7/1982 | Dopkowski | |
| 4,664,382 | A | 5/1987 | Palmer et al. | |
| 4,775,156 | A | 10/1988 | Thompson | |
| 4,948,132 | A | 8/1990 | Wharton | |
| 4,984,794 | A | 1/1991 | Pernelle et al. | |
| 5,165,688 | A | 11/1992 | Schmidt et al. | |
| 5,232,224 | A | 8/1993 | Zeider | |
| 5,275,399 | A | 1/1994 | Schmidt et al. | |
| 5,275,408 | A | 1/1994 | Desbiolles et al. | |
| 5,429,355 | A | 7/1995 | Schmidt et al. | |
| 5,443,442 | A | 8/1995 | Phipps et al. | |
| 5,577,726 | A | 11/1996 | Fenton | |
| 5,588,921 | A | 12/1996 | Parsick | |
| 5,626,528 | A | 5/1997 | Toulon | |
| 5,746,664 | A | 5/1998 | Reynolds, Jr. | |
| 5,816,931 | A | 10/1998 | Schooler | |
| 5,839,973 | A | 11/1998 | Jackson | |
| 5,851,155 | A | 12/1998 | Wood et al. | |
| 5,855,526 | A | 1/1999 | Honma | |
| 5,906,549 | A | 5/1999 | Kubica | |
| 6,095,929 | A | 8/2000 | Clark | |
| 6,149,533 | A | 11/2000 | Finn | |
| 6,203,443 | B1 | 3/2001 | Britton | |
| 6,251,028 | B1 | 6/2001 | Jackson | |
| 6,270,425 | B1 | 8/2001 | Dyer | |
| 6,273,828 | B1 | 8/2001 | Wood et al. | |
| 6,287,215 | B1 | 9/2001 | Fisher | |
| 6,319,146 | B1 | 11/2001 | Mills | |
| 6,332,945 | B1 | 12/2001 | Lenhof et al. | |
| 6,368,230 | B1 | 4/2002 | Helmstetter et al. | |
| 6,447,404 | B1 | 9/2002 | Wilbur | |
| 6,508,288 | B2 | 1/2003 | Lenhof et al. | |
| 6,524,197 | B2 | 2/2003 | Boone | |
| 6,547,673 | B2 | 4/2003 | Roark | |
| 6,652,388 | B1 | 11/2003 | Lenhof et al. | |
| 6,669,573 | B2 | 12/2003 | Wood et al. | |
| 6,797,106 | B2 | 9/2004 | Lenhof et al. | |
| 6,863,622 | B1 | 3/2005 | Hsu | |
| 6,890,269 | B2 * | 5/2005 | Burrows | 473/307 |
| 7,017,252 | B2 | 3/2006 | Lenhof et al. | |
| 7,083,529 | B2 | 8/2006 | Cackett et al. | |
| 7,115,046 | B1 | 10/2006 | Evans | |
| 7,163,463 | B2 * | 1/2007 | Mills | 473/244 |
| 7,300,359 | B2 | 11/2007 | Hocknell et al. | |
| 7,326,126 | B2 | 2/2008 | Holt et al. | |
| 7,335,113 | B2 | 2/2008 | Hocknell et al. | |
| 7,344,449 | B2 * | 3/2008 | Hocknell et al. | 473/307 |
| 7,367,896 | B2 | 5/2008 | Jackson | |
| 7,438,645 | B2 | 10/2008 | Hsu | |
| 7,445,563 | B1 | 11/2008 | Werner | |
| 7,465,239 | B2 * | 12/2008 | Hocknell et al. | 473/307 |
| 7,963,855 | B2 | 6/2011 | Sander et al. | |
| 2002/0037773 | A1 | 3/2002 | Wood et al. | |
| 2003/0236128 | A1 * | 12/2003 | Jackson | 473/244 |
| 2004/0229712 | A1 | 11/2004 | Jackson | |
| 2006/0229139 | A1 | 10/2006 | Johnson | |
| 2006/0293115 | A1 * | 12/2006 | Hocknell et al. | 473/305 |
| 2008/0051211 | A1 | 2/2008 | Hocknell et al. | |
| 2008/0058114 | A1 | 3/2008 | Hocknell et al. | |
| 2008/0070717 | A1 | 3/2008 | Hocknell et al. | |
| 2008/0280693 | A1 | 11/2008 | Chai | |
| 2009/0070717 | A1 | 3/2009 | Deutschle et al. | |
| 2010/0062873 | A1 | 3/2010 | Brady | |
| 2010/0063589 | A1 | 3/2010 | Tepic | |
| 2010/0084856 | A1 | 4/2010 | Wrobel et al. | |
| 2011/0021282 | A1 | 1/2011 | Sander | |

FOREIGN PATENT DOCUMENTS

| | | | | |
|---|---|---|---|---|
| JP | S63182775 | U | 11/1988 | |
| JP | 09103520 | A * | 4/1997 | A63B 53/02 |
| JP | 2000024143 | A | 1/2000 | |
| JP | 2006042951 | A | 2/2006 | |
| JP | 3127349 | U | 11/2006 | |
| JP | 2007215574 | A | 8/2007 | |
| JP | 2008167837 | A | 7/2008 | |

OTHER PUBLICATIONS

Nickent Golf, 4DX Evolver, web page product overview, Aug. 5, 2008, 2 pages, 222.nickentgolf.com.

* cited by examiner

RELEASABLE CONNECTIONS FOR GOLF CLUB HEADS AND SHAFTS

This application is a continuation of U.S. patent application Ser. No. 13/455,853 filed Apr. 25, 2012 which is a continuation of U.S. patent application Ser. No. 13/098,017 filed Apr. 29, 2011, now U.S. Pat. No. 8,182,358, issued May 22, 2012, which is a continuation of U.S. patent application Ser. No. 12/269,662 filed Nov. 12, 2008, now U.S. Pat. No. 7,963, 855, issued Jun. 21, 2011. This priority application is entirely incorporated herein by reference.

FIELD OF THE INVENTION

This invention relates generally to golf clubs and golf club heads. More particularly, aspects of this invention relate to golf clubs having releasable connections between the golf club head and the shaft and head/shaft position adjusting features to allow interchange of shafts and heads and to allow modification of the head/shaft positioning properties.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

Given the recent advances, there is a vast array of golf club component parts available to the golfer. For example, club heads are produced by a wide variety of manufacturers in a variety of different models. Moreover, the individual club head models may include multiple variations, such as variations in the loft angle, lie angle, offset features, weighting characteristics (e.g., draw biased club heads, fade biased club heads, neutrally weighted club heads, etc.). Additionally, the club heads may be combined with a variety of different shafts, e.g., from different manufacturers; having different stiffnesses, flex points, kick points, or other flexion characteristics, etc.; made from different materials; etc. Between the available variations in shafts and club heads, there are literally hundreds of different club head/shaft combinations available to the golfer.

Club fitters and golf professionals can assist in fitting golfers with a golf club head/shaft combination that suits their swing characteristics and needs. Conventionally, however, golf club heads are permanently mounted to shafts using cements or adhesives. Therefore, to enable a golfer to test a variety of head/shaft combinations, the club fitter or professional must carry a wide selection of permanently mounted golf club head/shaft combinations (which takes up a considerable amount of storage space and inventory costs) or the club fitter or professional must build new clubs for the customer as the fitting process continues (which takes a substantial amount of time and inventory costs). The disadvantages associated with these conventional options serve to limit the choices available to the golfer during a fitting session and/or significantly increase the expense and length of a session.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention relate to systems and methods for connecting golf club heads to shafts in a releasable manner so that the club heads and shafts can be readily interchanged and/or so that the angle and/or position of the shaft with respect to the club head body (and its ball striking face) can be readily changed. Golf club head/shaft connection assemblies in accordance with examples of this invention may include a golf club shaft, a golf club head, a shaft retainer, a hosel insert, and a shaft adapter. The golf club head may have an interior chamber. The hosel insert may be located at least partially within the interior chamber. The hosel insert may also have an outer perimeter and inner perimeter. The outer perimeter may be configured to be engaged within the interior chamber. The inner perimeter may include a rotation inhibiting structure. The hosel insert may be configured to releasably receive and secure the shaft retainer. The shaft retainer may be configured to be slidably engaged on the golf club shaft. The shaft adapter may have an upper end and a lower end. The upper end may be attached to the golf club shaft. The lower end may have a spherical member configured to mate with at least a portion of the rotation inhibiting structure to prevent rotation of the shaft adapter in relation to the club head. The shaft adapter may be inserted into the hosel insert of the golf club head at a plurality of different configurations. Each configuration may provide a different club characteristic than another configuration.

Furthermore, the shaft adapter may include an axial direction change region which when rotated may cause the club to have various angles and/or positions of the shaft with respect to the club head (e.g., variable lie, loft, and face angle combinations).

In one embodiment, the spherical connection assembly is a faceted ball. The rotation inhibiting structure may be defined by a mating face located within the inner perimeter of the hosel insert. The spherical member may include at least one facet that is configured to mate with the mating face. When the shaft adapter is in a first configuration, a first facet may be mated with the mating face. Conversely, when the spherical member is rotated within the hosel insert and when the shaft adapter is in a second configuration, a second facet may be mated with the mating face, which provides a different club characteristic than the first configuration.

In another embodiment, the spherical connection assembly is a pinned ball. The spherical member may include at least one shaft adapter pin groove. The rotation inhibiting structure may be defined by a roll pin and a hosel insert pin groove. The hosel insert pin groove may be configured to align with the shaft adapter pin groove in order to slide the roll pin through the hosel insert pin groove and the shaft adapter pin groove. When the shaft adapter is in a first configuration, a first shaft adapter pin groove is aligned with the hosel insert pin groove and pinned using the roll pin. Conversely, when the spherical member is rotated within the hosel insert and when the shaft adapter is in a second configuration, a second shaft adapter pin groove is aligned with the hosel insert pin groove and pinned using the roll pin, which provides a different club characteristic than the first configuration.

In another embodiment, the spherical connection assembly is a pin-and-hole. The rotation inhibiting structure may be defined by a mating face located within the inner perimeter of the hosel insert. The mating face may further include a plurality of different angled mating faces within the hosel insert. The spherical member may include a facet that is configured to mate with one of the mating faces. When the shaft adapter is in a first configuration, the facet may be mated with a first angled mating face. Conversely, when the spherical member is rotated within the hosel insert and when the shaft adapter is in a second configuration, the facet may be mated with a second angled mating face, which provides a different club characteristic than the first configuration.

In another embodiment, the spherical connection assembly is a tabbed ball. The spherical member may include a tab. The rotation inhibiting structure may be defined by at least one receiving slot located within the hosel insert and configured to receive the tab. When the shaft adapter is in a first configuration, the tab may be inserted into at least a first receiving slot. Conversely, when the spherical member is rotated within the hosel insert and when the shaft adapter is in a second configuration, the tab may be inserted into a second receiving slot, which provides a different club characteristic than the first configuration.

BRIEF DESCRIPTION OF THE DRAWINGS

A more complete understanding of the present invention and certain advantages thereof may be acquired by referring to the following detailed description in consideration with the accompanying drawings, in which:

FIG. 3A shows an exploded top perspective view of the golf club connection assembly and FIG. 3B shows a side/bottom perspective view of the golf club connection assembly;

FIG. 4A shows an exploded side perspective view of the golf club connection assembly and FIG. 4B shows a top perspective view of the golf club connection assembly connected to a golf club head;

FIG. 5A shows an exploded top perspective view of the golf club connection assembly, FIG. 5B shows a top perspective view of the hosel insert, and FIG. 5C shows a side perspective view of the golf club connection assembly connected to a golf club head;

FIG. 6A shows an exploded side perspective view of the golf club connection assembly and FIG. 6B shows a top perspective view of the golf club connection assembly connected to a golf club head.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example connection assemblies, golf club heads, and golf club structures in accordance with aspects of the invention. Additionally, it is to be understood that other specific arrangements of parts and structures may be utilized and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

In general, as described above, aspects of this invention relate to systems and methods for connecting golf club heads to shafts in a releasable manner so that the club heads and shafts can be readily interchanged and/or repositioned with respect to one another. Specific examples of the invention are described in more detail below. The reader should understand that these specific examples are set forth merely to illustrate examples of the invention, and they should not be construed as limiting the invention.

A. Examples of Specific Embodiments

1. Illustrative Club Structure

Figure 1:
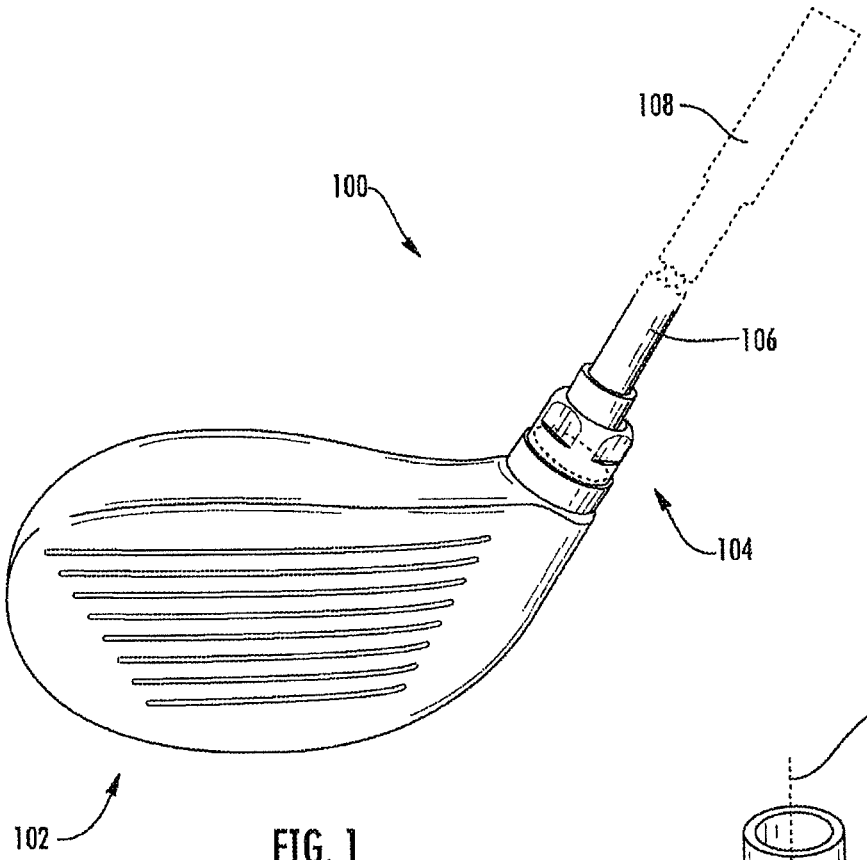
FIG. 1 illustrates a frontal view of an illustrative golf club according to embodiments of the invention.

FIG. 1 generally depicts an illustrative golf club 100 in accordance with at least some embodiments of the invention. The illustrative golf club 100 includes a club head 102, a releasable club head/shaft connection assembly 104 that connects the club head 102 to a shaft 106 (which will be described in more detail below), and a grip member 108 engaged with the shaft 106. While a driver or wood-type golf club head 102 is illustrated in FIG. 1, aspects of this invention may be applied to any type of club head, including, for example: fairway wood club heads; iron type golf club heads (of any desired loft, e.g., from a 0-iron or 1-iron to a wedge); wood or iron type hybrid golf club heads; putter heads; and the like. The club heads may be made from suitable materials, in suitable constructions, in suitable manners, as are known and used in the art, optionally modified (if necessary, e.g., in size, shape, etc.) to accommodate the releasable club head/shaft connection parts.

The various parts of the club head/shaft connection assembly 104 may be made from any desired or suitable materials without departing from this invention. For example, one or more of the various parts may be made from a metal material, including lightweight metals conventionally used in golf club head constructions, such as aluminum, titanium, magnesium, nickel, alloys of these materials, steel, stainless steel, and the like, optionally anodized finished materials. Alternatively, if desired, one or more of the various parts may be made from rigid polymeric materials, such as polymeric materials conventionally known and used in the golf club industry. The various parts may be made from the same or different materials without departing from this invention. In one specific example, each of the various parts will be made from a 7075 aluminum alloy material having a hard anodized finish. The parts may be made in suitable manners as are known and used in the metal working and/or polymer production arts.

Any desired materials also may be used for the shaft member 106, including suitable materials that are known and used in the art, such as steel, graphite, polymers, composite materials, combinations of these materials, etc. Optionally, if necessary or desired, the shaft may be modified (e.g., in size, shape, etc.) to accommodate the releasable club head/shaft connection parts. The grip member 108 may be engaged with the shaft 106 in any desired manner, including in any suitable manners that are known and used in the art (e.g., via cements or adhesives, via mechanical connections, etc.). Any desired materials may be used for the grip member 108, including suitable materials that are known and used in the art, such as rubber, polymeric materials, cork, rubber or polymeric materials with cord or other fabric elements embedded therein, cloth or fabric, tape, etc. Optionally, if desired, the grip member 108 (or any suitable handle member) may be releasably connected to the shaft 106 using a releasable connection like releasable connection assembly 104 (examples of which will be described in more detail below).

2. Illustrative Spherical Releasable Connection Assembly

Figure 3A:
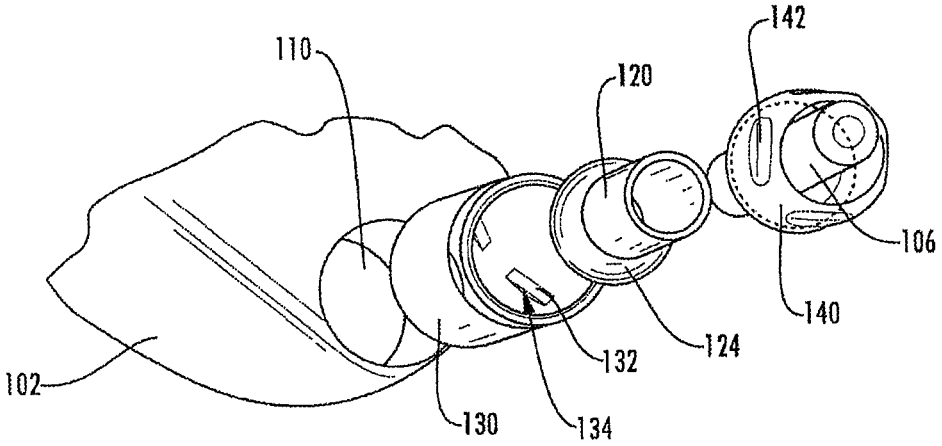
FIGS. 3A and 3B illustrate perspective views of a golf club connection with a faceted ball connection assembly according to an illustrative embodiment of the invention; specifically.
Figure 3B:
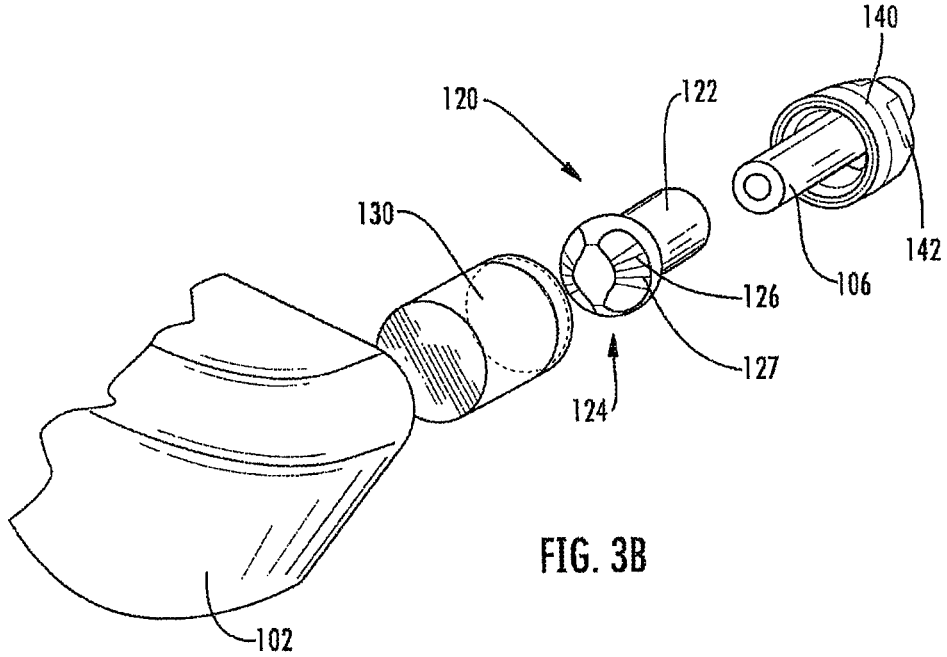

FIGS. 3A and 3B depict an illustrative embodiment for the spherical releasable connection assembly. The following general description about the spherical releasable connection assembly utilizes these FIGS. 3A and 3B. This general description also applies to the embodiments in FIGS. 4-6.

The spherical releasable connection assembly 104 between golf club heads and shafts in accordance with aspects of this invention may include a shaft adapter 120, a hosel insert 130, and a shaft retainer 140. The hosel insert 130 may be at least partially located within an interior chamber 110 of the golf club head 102. The shaft adapter 120 may be releasably connected to the hosel insert 130. The shaft retainer 140 may be slidably engaged along the golf club shaft 106 and may be secured to the hosel insert 130, thereby securing the shaft adapter 120 firmly against the hosel insert 130.

a. Interior Chamber

The golf club head 102 may comprise an interior chamber 110 configured to receive a hosel insert 130. The interior chamber 110 may be machined into the golf club head 102 during manufacturing of the head 102. In one embodiment, the chamber 110 is created by drilling or otherwise excavating a portion of golf club head 102. In this regard, at least a portion of the outer perimeter of the chamber 110 comprises the same materials as the golf club head 102. Yet in other embodiments, one or more different materials may be secured in any desired manner, e.g., via cements or adhesives; via welding, brazing, soldering, or other fusing techniques; via mechanical connectors; via a friction fit; etc. In one embodiment, the one or more materials may be less dense than the surrounding portion of the golf club head 102, as to provide absorbing properties and/or snug fit.

b. Hosel Insert

As shown in FIG. 3A, the interior chamber 110 may be configured to receive a hosel insert 130. The hosel insert 130 may be at least partially located within the interior chamber 110. Placement of the hosel insert 130 within the interior chamber 110 can reduce the likelihood of damaging the hosel insert 130 upon usage and storage of the club head 102, even in the event of external damage to the club head 102.

The hosel insert 130 has an outer perimeter and an inner perimeter. The outer perimeter may be configured to be engaged with the interior chamber 110 of the golf club head 102. The inner perimeter may include a rotation inhibiting structure 132. Illustrative rotation inhibiting structures 132 that may be used in accordance with embodiments of the invention are illustrated in FIGS. 3-6 and described in more detail below.

The hosel insert 130 is configured to releasably receive and secure a shaft retainer 140. As shown in FIG. 3A, the example hosel insert 130 comprises threaded securing structures that are configured to threadingly engage threaded structures of a complementing shaft retainer 140. The use of threaded structures permits tight precise fittings and allows for the quick separation of the golf club head 102 from the shaft retainer 140. While threaded securing structures may be used in certain embodiments, those of skill in the art will readily appreciate that any hosel insert 130 that releasably receives and secures a shaft retainer 140 is within the scope of the invention. For example, the hosel insert 130 may include other structures that hold a shaft retainer 140 in place. If desired, slots, openings, or grooves that provide access to structures extending from or into the hosel insert 130 and/or the shaft retainer 140 may be used to hold these components in place with respect to one another.

c. Shaft Adapter

Figure 2:
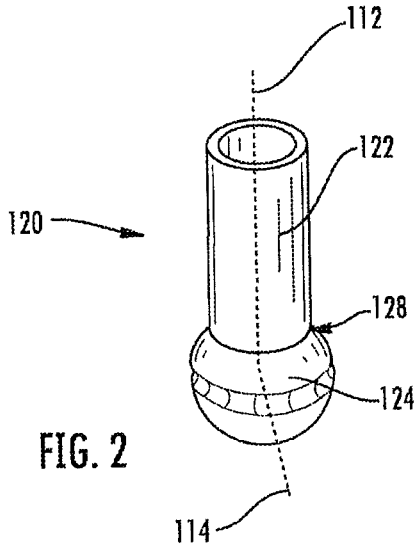
FIG. 2 provides a perspective view of a shaft adapter according to illustrative embodiments of the invention.

FIG. 2 shows an illustrative shaft adapter 120. The shaft adapter 120 has an upper end 122 and a lower end 124. The upper end 122 may be configured to securely attach to a club shaft (not shown), e.g., by cements or adhesives, by mechanical connectors (optionally releasable connectors), by friction fit, etc. As seen in FIGS. 3A and 3B, the illustrative shaft adapter 120 may be hollow and may be sized to receive a free end portion of a golf shaft 106. Conversely, the shaft adapter 120 may also be sized to be received within a hollow portion at the free end of a golf shaft 106. Those of skill in the art will readily appreciate that the shaft adapter 120 is not required to be hollow and may securely attach to a club shaft 106 by any suitable methods and mechanisms, including for example, e.g., via cements or adhesives; via welding, brazing, soldering, or other fusing techniques; via mechanical connectors; via a friction fit; etc. Further, the connection of the shaft adapter 120 to the golf club shaft 106 may be releasable, so as to allow the shaft to be easily and quickly switched. Yet, in other embodiments, the shaft adapter 120 may be integral to or otherwise permanently affixed to the shaft. This may be advantageous, for example, to prevent a user from using a less-than desirable shaft with a specific club head 102.

1. Spherical Member

The lower end 124 of the shaft adapter 120 may be defined by a spherical member. The spherical member 124 may be configured to releasably mate with the hosel insert 130. As will be discussed below, there may be many different examples of how the spherical member 124 and shaft adapter 120 can mate to the hosel insert 130. The spherical member 124 of the shaft adapter 120 may take on a wide variety of forms in golf club head/shaft connection assemblies 104 in accordance with examples of this invention. FIGS. 3A and 3B provide one example. As seen in FIG. 3A, the lower end 124 of the shaft adapter 120 comprises a spherical member 124 configured to mate with at least a portion of the rotation inhibiting structure 132 of the hosel insert 130.

In some examples, the spherical member 124 will extend less than 50% of an overall axial length of the shaft adapter 120, and it may extend less than 35%, less than 25%, or even less than 15% of the overall axial length of the shaft adapter 120. This feature can help keep the overall connection assembly relatively short, compact, and lightweight. As discussed below, the configuration of the shaft adapter 120 and its arrangement with respect to the club head body 102 may be utilized to adjust various positions and/or angles in relation to the golf club head 102 during use.

2. Direction Change Region

Additional aspects of this invention relate to the spherical member 124 having a direction change region. Releasable golf club head/shaft connection assemblies 104 may enable club fitters (or others) to adjust various positions and/or angles of the club head 102 (and its ball striking face) with respect to the free end (grip 108) of the shaft 106 (e.g., face angle, lie angle, loft angle, etc.). For example, FIG. 2 shows a perspective view of one embodiment of the shaft adapter 120. As shown in FIG. 2, the shaft adapter 120 may comprise an axial direction change region 128. The axial direction change region 128 may be defined by the area on the shaft adapter 120 where the upper end 122 extends coaxially toward a first axial direction 112 away from the axial direction change region 128. The lower end 124 may then extend coaxially toward a second axial direction 114. The axial direction change region 128 may be located at any desired position along the shaft adapter 120 without departing from this invention, and in this illustrative structure, the axial direction changes at the connection location of the spherical member 124 to the upper end 122 of the shaft adapter 120. In some other specific examples, the axial direction change region 128 may be located in the lower quarter of the shaft adapter 120 nearest to the club head 102, and even in the lower 10% or 5% of the shaft adapter 120 nearest to the club head 102.

Figure 7:
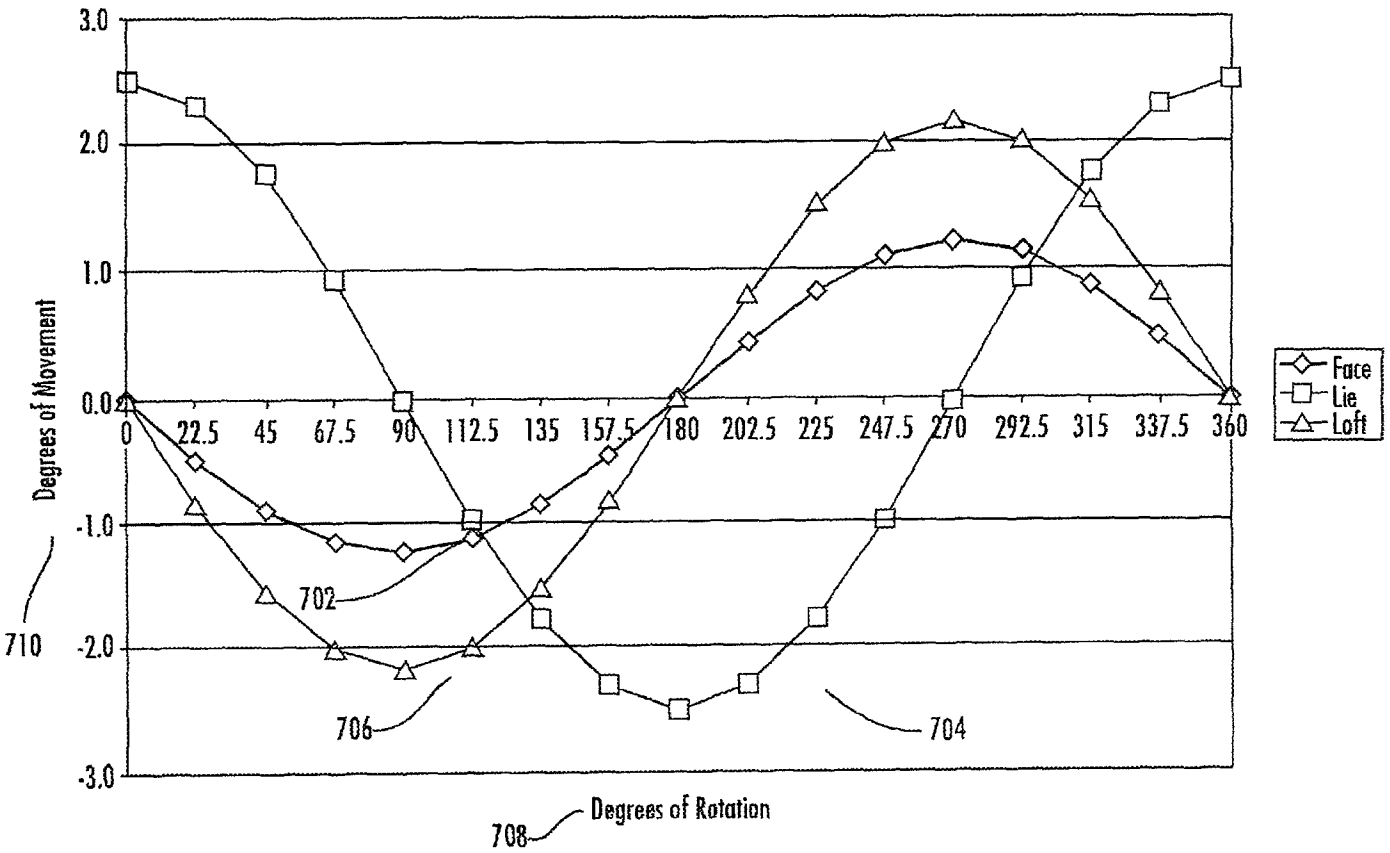
FIG. 7 is a chart illustrating the modification of certain characteristics of a golf club according to various embodiments of the invention.

Any desired axial direction change angle may be used without departing from this inventions, e.g., at least 0.25 degrees, at least 0.5 degrees, at least 1 degree, at least 2 degrees, at least 2.5 degrees, at least 4 degrees, or at least 8 degrees. FIG. 7 is a chart illustrating certain characteristics of a golf club that may be modified according to various embodiments of the invention where the shaft adapter's change direction region 128 is about 2.5 degrees (i.e., the shaft extends away from the club head hosel axis at an angle of about 2.5 degrees). Specifically, FIG. 7 illustrates the modification of the face angle 702, lie angle 704, and loft angle 706 when the orientation of the shaft adapter 120 is varied. As seen in FIG. 7, the X-axis 708 represents the "Degrees of Rotation," and the Y-axis 710 represents the "Degrees of Movement" of the various angles.

As seen in FIG. 7, when the X-axis 708 is at 0 degrees (e.g., at an arbitrarily defined base orientation for the club head 102), both the face angle 702 and the loft angle 706 are not modified from their base orientation, and therefore, register at around 0 degrees of movement on the Y-axis 710. The lie angle 704, however, is modified about 2.5 degrees (which represents the angle of the direction change region 102 between the shaft adapter's interior axis 114 and the hosel axis 112 of the club head 102 (from FIG. 2)). As the shaft adapter 120 is rotated within the hosel insert 130, all three angles (face, lie, and loft) change. As such, the placement of the shaft adapter 120 within the hosel insert 130 may be modified on a repeated basis to determine a user's preference, or still yet in other uses, be modified to accommodate multiple users.

Depending on how the shaft adapter 120 is placed within the club head 102, and thus how the axial direction change region 128 is oriented in relation to the "face" of the club head 102, the playing characteristics of the club may be modified. This feature, along with the releasable connection system 104, allows club fitters (or others) to freely and easily adjust various angles and/or positions of the shaft 106 with respect to the club head 102 (e.g., variable lie, loft, and face angle combinations) while still using the same shaft 106 and/or head 102, which can help users more easily determine the optimum club head/shaft combination and arrangement to suit their needs. The angle and/or position of the free end of the shaft 106 (at the location of the grip 108, remote from the connection assembly 104) may be altered with respect to the club head 102 (and with respect to the ball striking face) by differing the rotational placement of spherical member 124 within the club head 102. Illustrative embodiments are described below in relation to FIGS. 3-6.

If desired, the shaft adapter 120 and/or some portion of the club head 102 may be marked with indicia to indicate the rotational position of the shaft adapter 120 with respect to the club head 102, e.g., to allow users to better record the club head/shaft orientation and/or to allow a reliable return to a previous position after rotation of the shaft 106 has taken place.

d. Shaft Retainer

FIGS. 3A and 3B show perspective views of a shaft retainer 140 that may be utilized according certain embodiments of the invention to releasably secure the shaft adapter 120 to the head 102. The shaft retainer 140 may take the form of a hollow structure having an inner perimeter and an outer perimeter. The inner perimeter may be configured to be slidably engaged and rotated on a club shaft 106, including specific elements affixed to the shaft, including for example, the shaft adapter 120. The inner perimeter and/or shaft 106 may also be tapered or otherwise shaped or configured to prevent the shaft retainer 140 from being removed or otherwise falling off the shaft 106. In other illustrative structures, the ends of the shaft retainer 140 will be sized so as to engage the spherical member 124 provided on the shaft adapter 120, which also will prevent the shaft retainer 140 from being separated from the shaft 106.

The outer perimeter of the shaft retainer 140 may be configured to be secured by the hosel insert 130 within the club head 102. The outer perimeter may comprise threaded securing structures configured to threadingly engage threaded structures of the hosel insert 130. The threaded securing structures are merely an example of one implementation to releasably secure the shaft retainer 140 to the club head 102. The shaft retainer 140, however, may include other structures in addition to or in place of the threaded securing structures that may aid the securing and/or releasing of the shaft retainer 140 from the head 102. In yet further embodiments, the outer perimeter of the shaft retainer 140 comprises structures to assist a user from securing and/or releasing the shaft retainer 140 from the head 102. For example, as shown in FIGS. 3A and 3B, a gripping mechanism 142 may be affixed to the outer perimeter to further assist a user to tighten or loosen the connection between the head 102 and the shaft retainer 140, optionally with the use of a tool, such as a torque wrench or other wrench structure. Those of skill in the art will appreciate that the inner perimeter of the shaft retainer 140, as opposed to the outer perimeter, may also be configured to be secured by the hosel insert 130.

If desired, a cover element may be provided above the shaft retainer 140, to cover some or all of the shaft adapter 120 and/or the shaft retainer 140, and, if desired, to make the hosel junction appear more like a conventional hosel junction.

The spherical releasable connection assembly 104 between golf club heads and shafts in accordance with some aspects of this invention now will be described in more detail in conjunction with FIGS. 3-6.

B. Discussion of Specific Embodiments of Connection Assembly

To more clearly demonstrate the selected aspects, the various elements of FIGS. 3-6 have been consistently labeled with the reference numerals as provided in the previous figures to allow the reader to quickly refer back to the respective FIG. 1*f* required.

1. Faceted Ball Connection Assembly

FIGS. 3A and 3B provide a perspective view of an illustrative golf club head 102 with a faceted ball releasable connection assembly 104. FIG. 3A provides a top perspective view while FIG. 3B provides a side/bottom perspective view of the connection assembly 104. The faceted ball releasable connection assembly comprises a shaft adapter 120 and a hosel insert 130. The hosel insert 130 includes an inner perimeter and outer perimeter, wherein the inner perimeter may have a rotation inhibiting structure. The rotation inhibiting structure may be defined by a mating face 132 which is located on a protruding tab 134 within the inner perimeter of the hosel insert 130. There may be more than one protruding tab 134 and therefore more than one corresponding mating face 132 within the inner perimeter of the hosel insert 130.

The shaft adapter 120 includes an upper end 122 and a lower end 124. The upper end 122 is configured to be attached to the golf club shaft 106. The lower end 124 may be defined by a spherical member. The spherical member 124 may include at least one facet 126 which is configured to mate with the mating face 132 of the protruding tab 134. The facet 126 may be located along the circumference of the spherical member 124. When the shaft adapter 120 is inserted into the hosel insert 130, the facet 126 mates with the mating face 132 to prohibit rotation of the shaft adapter 120 and golf club shaft 106.

The shaft adapter 120 may contain multiple facets 126, 127 along the spherical member 124. The multiple facets 126, 127 may allow the shaft adapter 120 to be inserted into the hosel insert 130 with a first facet 126 mating with the mating face 132 of the hosel insert 130. The shaft adapter may then be rotated so that a second facet 127 mates with the mating face 132 of the hosel insert 130, etc. Those of skill in the art will appreciate that the shaft adapter 120 may be rotated and inserted into the hosel insert 130 in as many configurations as there are facets 126, 127 on the spherical member 124.

As described above, the shaft adapter 120 may include an axial change direction region 128 (from FIG. 2). The angle and/or position of the free end of the shaft 106 (at the location of the grip 108, remote from the connection assembly 104) may be altered with respect to the club head 102 by differing the rotational placement of spherical member 124 of shaft adapter 120 within the hosel insert 130. Therefore, when the shaft adapter 120 is rotated within the hosel insert 130, the axial change direction region 128 may cause the playing characteristics of the club (e.g., its face angle, its loft angle, its lie angle, etc.) to be modified or adjusted. This feature, along with the releasable connection assembly, allows club fitters (or others) to freely and easily adjust various angles and/or positions of the shaft 106 with respect to the club head 102 (e.g., variable lie, loft, and face angle combinations) while still using the same shaft 106 and head 102, which can help users more easily determine the optimum or desired club head/shaft combination and arrangement to suit their needs.

The assembly of the illustrative golf club head 102 with a faceted ball releasable connection assembly 104 as depicted in FIGS. 3A and 3B may be started by sliding the shaft 106 into the upper end 122 of the shaft adapter 120 with the shaft retainer 140 located on the shaft 106 above the shaft adapter 120. If desired, the shaft 106 may be fixed to the shaft adapter 120 (e.g., by cements or adhesives, by mechanical connectors, etc.). Once the shaft retainer 140 is rotatably and slidably engaged with the shaft 106, the overall connection then may be assembled.

The hosel insert 130 proximate to the exterior portion of the golf club head 102 is configured to releasably receive and secure the shaft retainer 140. The hosel insert 130 comprises threaded securing structures which are configured to threadingly engage the threaded structures of a complementing shaft retainer 140. The threaded securing structures of the hosel insert 130 may either be on the inner perimeter or the outer perimeter of the hosel insert 130. When the threaded securing structures of the hosel insert 130 are on the inner perimeter, a threaded portion on the exterior of the shaft retainer 140 engages the hosel insert 130. When the threaded securing structures of the hosel insert 130 are on the outer perimeter, a threaded portion on the interior of the shaft retainer 140 engages the hosel insert 130.

The shaft adapter 120 may then be inserted into the hosel insert 130 of the club head 102. As the shaft adapter 120 slides into the hosel insert 130, the mating face 132 of the hosel insert 130 will engage the corresponding facets 126, 127 of the shaft adapter 120 to thereby prevent the shaft 106 from rotating with respect to the club head 102.

Next in the assembly process, the shaft retainer 140 slides down the shaft 106 and/or shaft adapter 120 and threadingly engages threaded securing structures provided on the hosel insert 130. When the shaft retainer 140 is secured, the lower end surfaces of the shaft retainer 140 engage the spherical member 124, prohibiting the removal of the shaft adapter 120, thus securing the shaft 106 to the head 102. The shaft retainer 140 may further be tightened by the gripping mechanism 142 to ensure a tight consistent fit and proper alignment, e.g., using some type of torque wrench or other tool that engages the gripping mechanism 142. As discussed above, other releasable mechanical connection systems are possible without departing from this invention. Also, the various steps in this example assembly procedure may be changed, combined, changed in order, etc., without departing from this invention.

To release the connection of the assembly 104, the threaded (or other) securing structures of the shaft retainer 140 are released from the hosel insert 130, which allows the shaft adapter 120 to be released from the hosel insert 130 and the club head 102, while the shaft retainer 140 remains on the shaft 106. In this manner, a different shaft 106 can be quickly and easily engaged with the same club head 102 and/or a different club head 102 can be quickly and easily engaged with the same shaft 106. Alternatively, if desired, the shaft 106 may be rotated with respect to the club head 102 to vary the angles noted above, and a different facet 126, 127 may then be engaged with the mating face 132 at a different rotational orientation. Those of skill in the art will readily appreciate that methods relating to disassembling the connection assembly 104 is within the scope of the invention.

2. Pinned Ball Connection Assembly

Figure 4A:
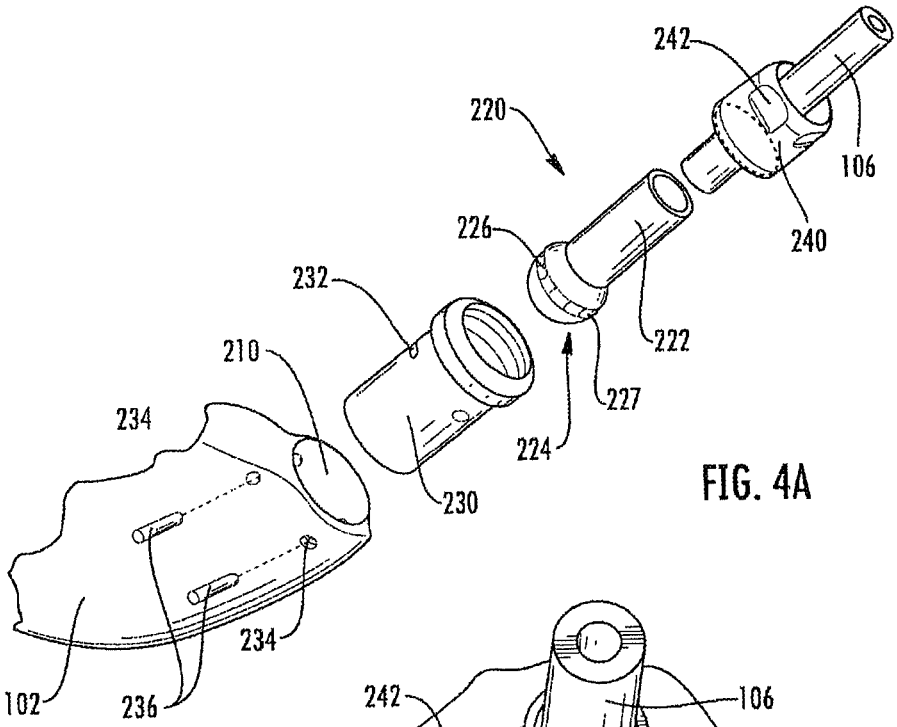
FIGS. 4A and 4B illustrate perspective views of a golf club connection assembly with a pinned ball connection assembly according to an illustrative embodiment of the invention; specifically.
Figure 4B:
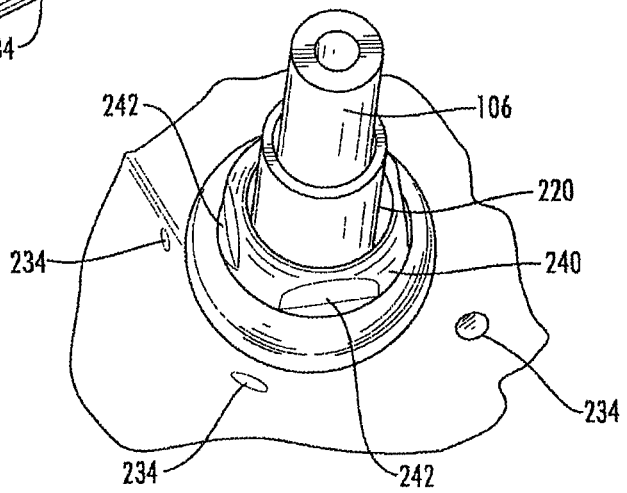

FIGS. 4A and 4B provide a perspective view of an illustrative golf club head 102 with a pinned ball releasable connection assembly 104. FIG. 4A provides a side perspective view while FIG. 3B provides a top perspective view of the connection assembly 104. The pinned ball releasable connection assembly comprises a shaft adapter 220 and a hosel insert 230.

The shaft adapter 220 includes an upper end 222 and a lower end 224. The upper end 222 may be configured to be attached to the golf club shaft 106. The lower end 224 may be defined by a spherical member 224. The spherical member 224 may include at least one shaft adapter pin groove 226.

The hosel insert 230 includes an inner perimeter and outer perimeter, wherein the inner perimeter may have a rotation inhibiting structure. The rotation inhibiting structure may be defined by a roll pin 236 and a hosel insert pin groove 232 within the hosel insert 230. The roll pin 236 is configured to be inserted into the hosel insert pin groove 232. More than one roll pin 236 and hosel insert pin groove 232 may be utilized in order to secure the shaft adapter 220 to the hosel insert 230. Also, there may be a club head pin groove 234 located within the club head 102 which aligns with the hosel insert pin groove 232.

When the shaft adapter 220 is inserted into the hosel insert 230, the shaft adapter pin groove 226 is aligned with the hosel insert pin groove 232 in order to slide the roll pin 236 through the hosel insert pin groove 232 and the shaft adapter pin groove 226 to prohibit rotation of the shaft adapter 220 and golf club shaft 106. The roll pin 236 may also be inserted through a club head pin groove 232, which aligns with the hosel insert pin groove 232 and the shaft adapter pin groove 226.

The shaft adapter 220 may contain multiple shaft adapter pin grooves 226, 227 along the spherical member 224. The multiple shaft adapter pin grooves 226, 227 may allow the shaft adapter 220 to be inserted into the hosel insert 230 with a first shaft adapter pin groove 226 aligning with the hosel insert pin groove 232. The shaft adapter 220 may then be rotated so that a second shaft adapter pin groove 227 aligns with the hosel insert pin groove 232, etc. Those of skill in the art will appreciate that the shaft adapter 220 may be rotated and inserted into the hosel insert 230 in as many configurations as there are shaft adapter pin grooves 226, 227 on the spherical member 224.

As described above, the shaft adapter 220 may include an axial change direction region 128 (from FIG. 2). The angle and/or position of the free end of the shaft 106 (at the location of the grip 108, remote from the connection assembly 104) may be altered with respect to the club head 102 by differing the rotational placement of spherical member 224 of shaft adapter 220 within the hosel insert 230. Therefore, when the shaft adapter 220 is rotated within the hosel insert 230, the axial change direction region 128 may cause the playing characteristics of the club (e.g., its face angle, its loft angle, its lie angle, etc.) to be modified or adjusted. This feature, along with the releasable connection assembly 104, allows club fitters (or others) to freely and easily adjust various angles and/or positions of the shaft 106 with respect to the club head 102 (e.g., variable lie, loft, and face angle combinations) while still using the same shaft 106 and club head 102, which can help users more easily determine the optimum or desired club head/shaft combination and arrangement to suit their needs.

The assembly of the illustrative golf club head 102 with a pinned ball releasable connection assembly 104 as depicted in FIGS. 4A and 4B may begin by sliding the shaft 106 into the upper end 222 of the shaft adapter 220 with the shaft retainer 240 located on the shaft 106 above the shaft adapter 220. If desired, the shaft 106 may be fixed to the shaft adapter 220 (e.g., by cements or adhesives, by mechanical connectors, etc.). Once the shaft retainer 240 is rotatably and slidably engaged with the shaft 106, the overall connection then may be assembled.

The hosel insert 230 proximate to the exterior portion of the golf club head 102 is configured to releasably receive and secure the shaft retainer 240. The hosel insert 230 comprises threaded securing structures which are configured to threadingly engage the threaded structures of a complementing shaft retainer 240. The threaded securing structures of the hosel insert 230 may either be on the inner perimeter or the outer perimeter of the hosel insert 230. When the threaded securing structures of the hosel insert 230 are on the inner perimeter, a threaded portion on the exterior of the shaft retainer 240 engages the hosel insert 230. When the threaded securing structures of the hosel insert 230 are on the outer perimeter, a threaded portion on the interior of the shaft retainer 240 engages the hosel insert 230.

The shaft adapter 220 may then be inserted into the hosel insert 230 of the club head 102. As the shaft adapter 220 slides into the hosel insert 220, the shaft adapter pin groove 226 and the hosel insert pin groove 232 align with each other in order to slide the roll pin 236 through each of the grooves 226, 232, thereby preventing the shaft 106 from rotating with respect to the club head 102. This action may be repeated if there is more than one roll pin 236 to be inserted into the pin grooves 226, 232.

Next in the assembly process, the shaft retainer 240 slides down the shaft 106 and/or shaft adapter 220 and threadingly engages the threaded securing structures provided on the hosel insert 230. When the shaft retainer 240 is secured, the lower end surfaces of the shaft retainer 240 engage the spherical member 224, prohibiting the removal of the shaft adapter 220, thus securing the shaft 106 to the head 102. The shaft retainer 240 may further be tightened by the gripping mechanism 242 to ensure a tight consistent fit and proper alignment, e.g., using some type of torque wrench or other tool that engages the gripping mechanism 242. As discussed above, other releasable mechanical connection systems are possible without departing from this invention. Also, the various steps in this example assembly procedure may be changed, combined, changed in order, etc., without departing from this invention.

To release the connection of the assembly 104, the threaded (or other) securing structures of the shaft retainer 240 are released from the hosel insert 230. The roll pins 236 must then be slid out from the pin grooves 226, 232 in order to allow the shaft adapter 220 to be removed from the hosel insert 230 of the club head 102, while the shaft retainer 240 remains on the shaft 106. In this manner, a different shaft 106 can be quickly and easily engaged with the same club head 102 and/or a different club head 102 can be quickly and easily engaged with the same shaft 106. Alternatively, if desired, the shaft 106 may be rotated with respect to the club head 102 to vary the angles noted above, and a different set of shaft adapter pin grooves 226, 227 may then be aligned with the hosel insert pin grooves 232 at a different rotational orientation. Those of skill in the art will readily appreciate that methods relating to disassembling the assembly 104 is within the scope of the invention.

3. Pin-and-hole Connection Assembly

Figure 5A:
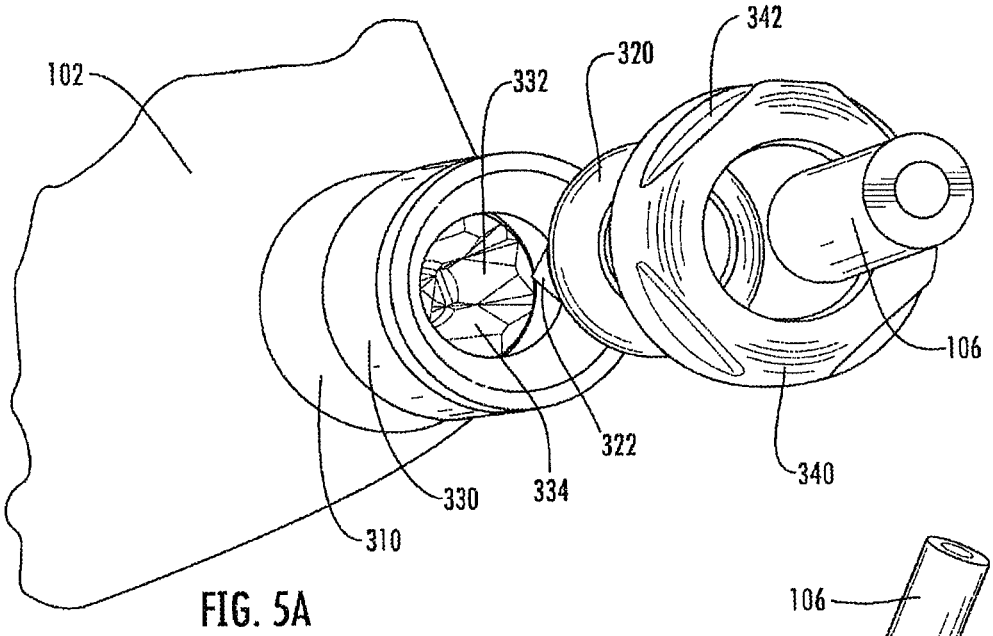
FIGS. 5A-5C illustrate perspective views of a golf club connection with a pin-and-hole connection assembly according to an illustrative embodiment of the invention; specifically.
Figure 5B:
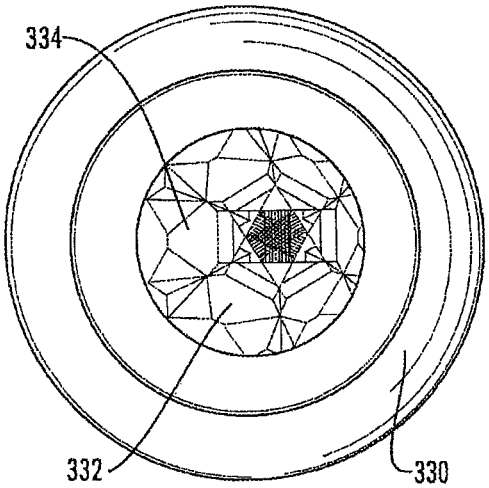
Figure 5C:
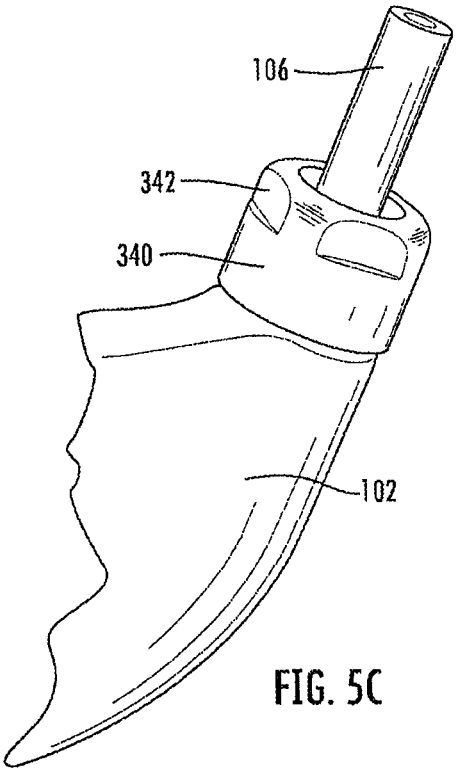

FIGS. 5A-5C provide a perspective view of an illustrative golf club head 102 with a pin-and-hole releasable connection assembly 104. FIG. 5A provides a top perspective view while FIG. 5B provides a top perspective view of the hosel insert 330, and FIG. 5C provides a side perspective view of the connection assembly completed. The pin-and-hole releasable connection assembly comprises a shaft adapter 320 and a hosel insert 330.

The hosel insert 330 includes an inner perimeter and outer perimeter, wherein the inner perimeter may have a rotation inhibiting structure. The rotation inhibiting structure may be defined by a mating face 332 located within the inner perimeter of the hosel insert 330. The mating face 332 may be further defined by a plurality of different angled mating faces within the hosel insert 330. FIG. 5B depicts six different angled mating faces. Those of skill in the art will appreciate that more than six angled mating faces and less than six angled mating faces may be used.

The shaft adapter 320 may be configured to be attached to the golf club shaft 106. The shaft adapter 320 may be defined by a spherical member. The spherical member 320 may include a facet 322, wherein the facet 322 is configured to mate with the mating face 332. The facet 322 may be further defined by a cone-shaped structure 322 on the end of the spherical member 320. The cone-shaped structure 322 is configured to slidingly fit into and mate with the angled mating faces 332, 334. When the shaft adapter 320 is inserted into the hosel insert 330, the cone-shaped structure 322 mates with one of the angled mating faces 332 to prohibit rotation of the shaft adapter 320 and golf club shaft 106.

As depicted in FIG. 5B, the hosel insert 330 may contain multiple angled mating faces 332, 334 within the interior of the hosel insert 330. The multiple angled mating faces 332, 334 may allow the shaft adapter 320 to be inserted into the hosel insert 330 with the cone shaped structure 322 mating with a first angled mating face 332. The shaft adapter 320 may then be rotated so that the cone shaped structure 322 mates with a second angled mating face 334, etc. Those of skill in the art will appreciate that the shaft adapter 320 may be rotated and inserted into the hosel insert 330 in as many configurations as there are angled mating faces 332, 334.

As described above, the shaft adapter 320 may include an axial change direction region 128 (from FIG. 2). The angle and/or position of the free end of the shaft 106 (at the location of the grip 108, remote from the connection assembly 104) may be altered with respect to the club head 102 by differing the rotational placement of shaft adapter 320 within the hosel insert 330. Therefore, when the shaft adapter 320 is rotated within the hosel insert 330, the axial change direction region 128 may cause the playing characteristics of the club (e.g., its face angle, its loft angle, its lie angle, etc.) to be modified or adjusted. This feature, along with the releasable connection assembly 104, allows club fitters (or others) to freely and easily adjust various angles and/or positions of the shaft 106 with respect to the club head 102 (e.g., variable lie, loft, and face angle combinations) while still using the same shaft 106 and head 102, which can help users more easily determine the optimum or desired club head/shaft combination and arrangement to suit their needs.

The assembly of the illustrative golf club head with a pin-and-hole releasable connection assembly 104 as depicted in FIGS. 5A-5C may be started by sliding the shaft adapter 320 onto the shaft 106 with the shaft retainer 340 located above the shaft adapter 320. If desired, the shaft 106 may be fixed to the shaft adapter 320 (e.g., by cements or adhesives, by mechanical connectors, etc.). Once the shaft retainer 340 is rotatably and slidably engaged with the shaft 106, the overall connection then may be assembled.

The hosel insert 330 proximate to the exterior portion of the golf club head 102 is configured to releasably receive and secure the shaft retainer 340. The hosel insert 330 comprises threaded securing structures which are configured to threadingly engage the threaded structures of a complementing shaft retainer 340. The threaded securing structures of the hosel insert 330 may either be on the inner perimeter or the outer perimeter of the hosel insert 330. When the threaded securing structures of the hosel insert 330 are on the inner perimeter, a threaded portion on the exterior of the shaft retainer 340 engages the hosel insert 330. When the threaded securing structures of the hosel insert 330 are on the outer perimeter, a threaded portion on the interior of the shaft retainer 340 engages the hosel insert 330.

The shaft adapter 320 may then be inserted into the hosel insert 330 of the club head 102. As the shaft adapter 320 slides into the hosel insert 330, the cone shaped structure 322 of the shaft adapter 320 mates with one of the angled mating faces 332, thereby preventing the shaft 106 from rotating with respect to the club head 102. This action may be repeated if there are multiple angled mating faces 332, 334.

Next in the assembly process, the shaft retainer 340 slides down the shaft 106 and/or shaft adapter 320 and threadingly engages threaded securing structures provided on the hosel insert 330. When the shaft retainer 340 is secured, the lower end surfaces of the shaft retainer 340 engage the spherical member of the shaft adapter 320, which prohibits the removal of the shaft adapter 320, thus securing the shaft 106 to the head 102. The shaft retainer 340 may further be tightened by the gripping mechanism 342 to ensure a tight consistent fit and proper alignment, e.g., using some type of torque wrench or other tool that engages the gripping mechanism 342. As discussed above, other releasable mechanical connection systems are possible without departing from this invention. Also, the various steps in this example assembly procedure may be changed, combined, changed in order, etc., without departing from this invention.

To release the connection of the assembly 104, the threaded (or other) securing structures of the shaft retainer 340 are released from the hosel insert 330, which allows the shaft adapter 320 to be released from the hosel insert 330 and the club head 102, while the shaft retainer 340 remains on the shaft 106. In this manner, a different shaft 106 can be quickly and easily engaged with the same club head 102 and/or a different club head 102 can be quickly and easily engaged with the same shaft 106. Alternatively, if desired, the shaft 106 may be rotated with respect to the club head 102 to vary the angles noted above, and the cone-shaped structure 322 may be inserted into a different angled mating face 332, 334 at a different rotational orientation. Those skilled in the art will readily appreciate that methods relating to disassembling the assembly 104 is within the scope of the invention.

4. Tabbed Ball Connection Assembly

Figure 6A:
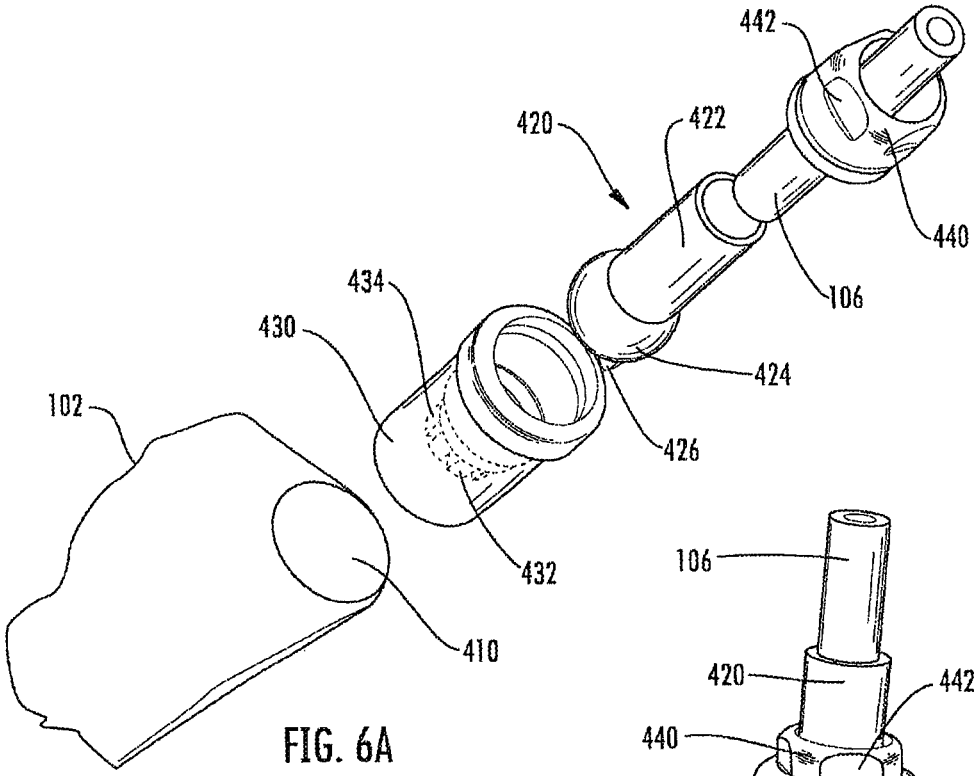
FIGS. 6A and 6B illustrate perspective views of a golf club connection with a tabbed ball connection assembly according to an illustrative embodiment of the invention; specifically.
Figure 6B:
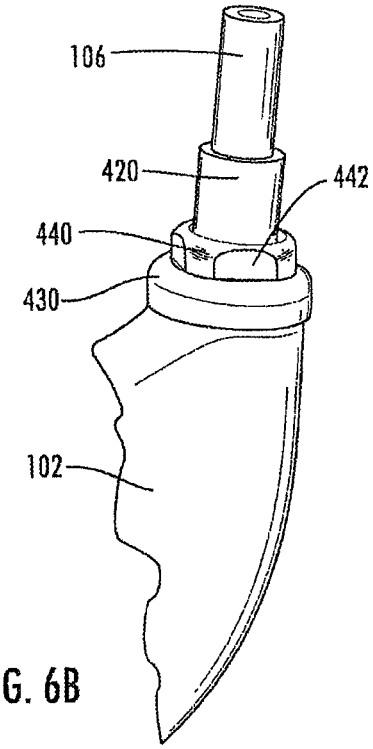

FIGS. 6A and 6B provide a perspective view of an illustrative golf club head 102 with a tabbed ball releasable connection assembly 104. FIG. 6A provides a side perspective view of the connection assembly while FIG. 6B provides a side perspective view of the connection assembly completed. The tabbed ball releasable connection assembly comprises a shaft adapter 420 and a hosel insert 430.

The shaft adapter 420 includes an upper end 422 and a lower end 424. The upper end 422 may be configured to be attached to the golf club shaft 106. The lower end 424 may be defined by a spherical member. The spherical member 424 may include at least one tab 426. The tab 426 may be located on the end of the spherical member 424.

The hosel insert 430 includes an inner perimeter and outer perimeter, wherein the inner perimeter may have a rotation inhibiting structure. The rotation inhibiting structure may be defined by at least one receiving slot 432 within the inner perimeter of the hosel insert 430. The receiving slot 432 is configured to receive the tab 426. When the shaft adapter 420 is inserted into the hosel insert 430, the tab 426 slides into the receiving slot 432 of the hosel insert 430 to prohibit rotation of the shaft adapter 420 and golf club shaft 106.

The hosel insert 430 may contain multiple receiving slots 432, 434 within the interior of the hosel insert 430. The multiple receiving slots 432, 434 may allow the shaft adapter 420 to be inserted into the hosel insert 430 with the tab 426 sliding into a first receiving slot 432. The shaft adapter 420 may then be rotated so that the tab 426 slides into a second receiving slot 434, etc. Those of skill in the art will appreciate that the shaft adapter 420 may be rotated and inserted into the hosel insert 430 in as many configurations as there are receiving slots 432, 434.

As described above, the shaft adapter 420 may include an axial change direction region 128 (from FIG. 2). The angle and/or position of the free end of the shaft 106 (at the location of the grip 108, remote from the connection assembly 104) may be altered with respect to the club head 102 by differing the rotational placement of spherical member of shaft adapter 420 within the hosel insert 430. Therefore, when the shaft adapter 420 is rotated within the hosel insert 430, the axial change direction region 128 may cause the playing characteristics of the club (e.g., its face angle, its loft angle, its lie angle, etc.) to be modified or adjusted. This feature, along with the releasable connection assembly 104, allows club fitters (or others) to freely and easily adjust various angles and/or positions of the shaft 106 with respect to the club head 102 (e.g., variable lie, loft, and face angle combinations) while still using the same shaft 106 and head 102, which can help users more easily determine the optimum club head/shaft combination and arrangement to suit their needs.

The assembly of the illustrative golf club head 102 with a tabbed ball releasable connection assembly 104 as depicted in FIGS. 6A and 6B may be started by sliding the shaft 106 into the upper end 422 of the shaft adapter 420 with the shaft retainer 440 located on the shaft 106 above the adapter 420. If desired, the shaft 106 may be fixed to the shaft adapter 420 (e.g., by cements or adhesives, by mechanical connectors, etc.). Once the shaft retainer 440 is rotatably and slidably engaged with the shaft 106, the overall connection then may be assembled.

The hosel insert 430 proximate to the exterior portion of the golf club head 102 is configured to releasably receive and secure the shaft retainer 440. The hosel insert 430 comprises threaded securing structures which are configured to threadingly engage the threaded structures of a complementing shaft retainer 440. The threaded securing structures of the hosel insert 430 may either be on the inner perimeter or the outer perimeter of the hosel insert 430. When the threaded securing structures of the hosel insert 430 are on the inner perimeter, a threaded portion on the exterior of the shaft retainer 440 engages the hosel insert 430. When the threaded securing structures of the hosel insert 430 are on the outer perimeter, a threaded portion on the interior of the shaft retainer 440 engages the hosel insert 430.

The shaft adapter 420 may then be inserted into the hosel insert 430 of the club head 102. As the shaft adapter 420 slides into the hosel insert 430, the tab 426 of the spherical member 424 slides into one of the receiving slots 432 within the hosel insert 430, thereby preventing the shaft 106 from rotating with respect to the club head 102. This action may be repeated if there are multiple receiving slots 432, 434 within the hosel insert 430.

Next in the assembly process, the shaft retainer 440 slides down the shaft 106 and/or shaft adapter 420 and threadingly engages threaded securing structures provided on the hosel insert 430. When the shaft retainer 440 is secured, the lower end surfaces of the shaft retainer 440 engage the spherical member 424, prohibiting the removal of the shaft adapter 420, thus securing the shaft 106 to the head 102. The shaft retainer 440 may further be tightened by the gripping mechanism 442 to further ensure a tight consistent fit and proper alignment, e.g., using some type of torque wrench or other tool that engages the gripping mechanism 442. As discussed above, other releasable mechanical connection systems are possible without departing from this invention. Also, the various steps in this example assembly procedure may be changed, combined, changed in order, etc., without departing from this invention.

To release the connection of the assembly 104, the threaded (or other) securing structures of the shaft retainer 440 are released from the hosel insert 430, which allows the shaft adapter 420 to be released from the hosel insert 430 of the club head 102, while the shaft retainer 440 remains on the shaft 106. In this manner, a different shaft 106 can be quickly and easily engaged with the same club head 102 and/or a different club head 102 can be quickly and easily engaged with the same shaft 106. Alternatively, if desired, the shaft 106 may be rotated with respect to the club head 102 to vary the angles noted above, and the tab 426 is inserted into a different receiving slot 432, 434 at a different rotational orientation. Those of skill in the art will readily appreciate that methods relating to disassembling the assembly 104 is within the scope of the invention.

C. Additional Embodiments

The releasable connection assemblies 104 may be used in any desired manner without departing from the invention. The clubs with such connection assemblies may be designed for use by the golfer in play (and optionally, if desired, the golfer may freely change shafts, heads, and/or their positioning with respect to one another). As another example, if desired, clubs including releasable connections in accordance with the invention may be used as club fitting tools and when the desired combination of head, shaft, and positioning have been determined for a specific golfer, a club builder may use the determined information to then produce a final desired golf club product using suitable (and permanent) mounting techniques (e.g., cements or adhesives). Other variations in the club/shaft connection assembly parts and processes are possible without departing from this invention.

Many variations in the overall structure of the shaft, club head, and club head/shaft connection assembly are possible without departing from this invention. Furthermore, the various steps of the described assembly processes may be altered, changed in order, combined, and/or omitted without departing from the invention. Additionally or alternatively, if desired, in such structures, the club head can be quickly and easily exchanged for a different one on the shaft (e.g., a club head of different loft, lie angle, size, brand, etc.).

Conclusion

While the invention has been described in detail in terms of specific examples including presently preferred modes of carrying out the invention, those of skill in the art will appreciate that there are numerous variations and permutations of the above described systems and methods. Thus, the spirit and scope of the invention should be construed broadly as set forth in the appended claims.

We claim:

1. A golf club, comprising:

a golf club shaft;

a golf club head having an interior chamber;

a shaft retainer configured to be slidably engaged with the golf club shaft;

a hosel insert configured to releasably receive and secure the shaft retainer, the hosel insert located at least partially within the interior chamber and having an outer perimeter and an inner perimeter, wherein the outer perimeter is configured to be engaged with the interior chamber; and a shaft adapter having an upper end and a lower end, wherein the upper end is attached to the golf club shaft and the lower end has a spherical member that engages the inner perimeter of the hosel insert, wherein the shaft adapter is configured to be inserted into the hosel insert at a plurality of different configurations, wherein a first configuration provides different club characteristics than a second configuration, wherein in the first configuration the spherical member is in a different rotational position within the hosel insert than in the second configuration, and further wherein the shaft adapter comprises an axial direction change region configured to offset an axis of the shaft with respect to a hosel axis of the golf club head, wherein the axial direction change region is an area on the shaft adapter where the upper end extends coaxially toward a first axial direction away from the axial direction change region, and further wherein the lower end extends coaxially toward a second axial direction different than the first axial direction.

2. The golf club of claim 1, wherein the club characteristics include one or more of a lie angle of the club head, a face angle of the club head, and a loft angle of the club head.

3. The golf club of claim 1, wherein the offset is about 1 degree.

4. The golf club of claim 1, wherein the offset is about 2.5 degrees.

5. The golf club of claim 1, wherein the shaft retainer includes threaded structures and the hosel insert comprises threaded securing structures configured to threadingly engage the threaded structures to lock the shaft retainer inside the hosel insert and prevent rotation of the shaft adapter in relation to the club head.

6. The golf club of claim 5, wherein the threaded structures of the shaft retainer are located on the exterior of the shaft retainer and the threaded securing structures of the hosel insert are on the inner perimeter of the hosel insert.

7. The golf club of claim 1, wherein the shaft retainer further comprises a gripping structure configured to aid a user in connecting the shaft retainer to and disconnecting the shaft retainer from the hosel insert.

8. The golf club of claim 1, wherein the spherical member includes at least one facet configured to mate with a mating face.

9. The golf club of claim 8, wherein the at least one facet is located along the circumference of the spherical member.

10. The golf club of claim 8, wherein when the shaft adapter is in the first configuration, a first facet of the spherical member mates with the mating face, and when the shaft adapter is in the second configuration, a second facet of the spherical member is mated with the mating face, and wherein in the first configuration the spherical member is in a different rotational position within the hosel insert than in the second configuration.

11. A connection assembly for releasably connecting a golf club shaft and golf club head comprising:

a shaft retainer configured to be slidably engaged with a golf club shaft;

a hosel insert configured to releasably receive and secure the shaft retainer, the hosel insert having an outer perimeter and an inner perimeter, wherein the outer perimeter is configured to be engaged with a golf club head; and a shaft adapter having an upper end and a lower end, wherein the lower end has a spherical member that engages the inner perimeter of the hosel insert, wherein the shaft adapter is configured to be inserted into the hosel insert at a plurality of different configurations, wherein a first configuration provides different club characteristics than a second configuration, wherein in the first configuration the spherical member is in a different rotational position within the hosel insert than in the second configuration, and further wherein the shaft adapter comprises an axial direction change region configured to offset an axis of the shaft with respect to a hosel axis of the golf club head, wherein the axial direction change region is an area on the shaft adapter where the upper end extends coaxially toward a first axial direction away from the axial direction change region, and further wherein the lower end extends coaxially toward a second axial direction different than the first axial direction.

12. The connection assembly of claim 11, wherein the club characteristics include one or more of a lie angle of the club head, a face angle of the club head, and a loft angle of the club head.

13. The connection assembly of claim 11, wherein the offset is about 1 degree.

14. The connection assembly of claim 11, wherein the offset is about 2.5 degrees.

15. The connection assembly of claim 11, wherein the shaft retainer includes threaded structures and the hosel insert comprises threaded securing structures configured to threadingly engage the threaded structures to lock the shaft retainer inside the hosel insert and prevent rotation of the shaft adapter in relation to the club head.

16. The connection assembly of claim 15, wherein the threaded structures of the shaft retainer are located on the exterior of the shaft retainer and the threaded securing structures of the hosel insert are on the inner perimeter of the hosel insert.

17. The connection assembly of claim 11, wherein the shaft retainer further comprises a gripping structure configured to aid a user in connecting the shaft retainer to and disconnecting the shaft retainer from the hosel insert.

18. The connection assembly of claim 11, wherein the spherical member includes at least one facet configured to mate with a mating face.

19. The connection assembly of claim 18, wherein the at least one facet is located along the circumference of the spherical member.

20. The connection assembly of claim 18, wherein when the shaft adapter is in the first configuration, a first facet of the spherical member mates with the mating face, and when the shaft adapter is in the second configuration, a second facet of the spherical member is mated with the mating face, and wherein in the first configuration the spherical member is in a different rotation position within the hosel insert than in the second configuration.

* * * * *